United States Patent [19]

Tillotson

[11] 4,204,738

[45] May 27, 1980

[54] ELECTRICAL CONNECTOR RETAINING DEVICE

[75] Inventor: Henry B. Tillotson, Minneapolis, Minn.

[73] Assignee: The Toro Company, Minneapolis, Minn.

[21] Appl. No.: 892,262

[22] Filed: Mar. 31, 1978

[51] Int. Cl.[2] ..... H01R 13/54

[52] U.S. Cl. ..... 339/75 P

[58] Field of Search ..... 339/75 P, 91 R, 10, 339/44 R, 44 M, 101, 106

[56] References Cited

U.S. PATENT DOCUMENTS

| | | | |
|---|---|---|---|
| 1,665,095 | 4/1928 | Henry | 339/75 P |
| 1,874,334 | 8/1932 | Nero | 339/75 P X |
| 2,725,543 | 11/1955 | Tanner | 339/91 R |
| 2,753,536 | 7/1956 | Tjader | 339/75 P |
| 2,984,815 | 5/1961 | Landon et al. | 339/75 P |
| 3,017,598 | 1/1962 | Low | 339/75 P |
| 3,400,361 | 9/1968 | Okun | 339/75 P |
| 3,475,716 | 10/1969 | Laig | 339/75 P |
| 3,484,736 | 12/1969 | Wyse | 339/75 P X |
| 3,609,638 | 9/1971 | Darrey | 339/75 P |
| 3,611,265 | 10/1971 | Shurtz | 339/75 P |
| 3,613,046 | 10/1971 | Kirk | 339/75 P |

FOREIGN PATENT DOCUMENTS

| | | | |
|---|---|---|---|
| 851652 | 10/1952 | Fed. Rep. of Germany . | |
| 863366 | 1/1953 | Fed. Rep. of Germany | 339/75 P |

*Primary Examiner*—Roy Lake
*Assistant Examiner*—Eugene F. Desmond
*Attorney, Agent, or Firm*—Merchant, Gould, Smith, Edell, Welter & Schmidt

[57] ABSTRACT

A device for securely retaining, in a mated configuration: an electrical connector, such as one used on an electrical power implement, and a compatible electrical connector, such as in use with electrical power extension cords. In a preferred embodiment disclosed, retention is accomplished by a wire clip which clasps a multi-position cannelured mating element carried by the extension cord. The wire clip is formed within a wire bail pivotally mounted to the connector of the electrical power implement.

7 Claims, 4 Drawing Figures

ELECTRICAL CONNECTOR RETAINING DEVICE

BACKGROUND OF THE INVENTION

The invention of this application relates to devices for securely retaining an electrical connector of an electrical power implement with an electrical connector of an electrical power extension cord. Power extension cords are necessary to transmit electricity from a conventional electrical power outlet to the implement, thereby providing the implement with a source of electricity even when it is used at locations remote from the outlet.

Because of the nature of such implements and the necessity of remote use, it is essential that they be provided with a degree of mobility. The necessity for this mobility aspect of the implement frequently presents problems relating to the maintenance of continuous and secure connection of the implement to the power transmission cord.

Prior structures have attempted to solve this problem in a number of ways. All proferred solutions have a number of inherent disadvantages, however.

Some structures, although allowing for complete and secure mating, provide for no interchangeability of components. In this type of structure, the retention components are permanently affixed to the electrical power implement and the extension cord with which the implement is to be used. Should the extension cord prove defective or subsequently deteriorate, configuration of another conventional cord for secure retention as provided by the structure is, therefore, virtually precluded.

A disadvantage of other structures is that an extension cord carrying only a certain sized electrical connector can be accomodated. This is so because the retention components are of fixed dimensions. Consequently, here again, the user of the implement is restricted in his ability to interchange extension cords. Yet other structures hinder the mating of the electrical connector. The retention device, while it may ensure secure mating, may, as a result, render connection extremely difficult. It is a corollary that disconnection is equally difficult.

The invention of the present application provides solutions which cure these deficiencies.

SUMMARY OF THE INVENTION

The present invention is a device for securely retaining electrical connectors in a mated configuration and includes a retention member which is pivotally mounted to an electrical connector and a means for accomplishing such pivotal mounting. The pivotal aspect of the retention member facilitates easy connection and disconnection of the connector to which the retention member is mounted and a second compatible electrical connector. In addition to this "free access" advantage, the pivotal characteristic allows the retention member to be swung clear of the electrical connector during storage of the implement of which the connector is a component so as to preclude inadvertant damage.

The invention further includes a clasping means carried by the retention member proximate the end opposite the pivotal mounting and a mating means associated with the second connector for accepting the clasping means. Secure mating of the two electrical connectors is accomplished when the clasping means carried by the retention member is made to clutch the mating means associated with the second connector. A plurality of connection points formed in the mating means permits flexibility of size of the second electrical connector. This plurality of points further ensures complete mating of the electrical connectors and precludes partial disengagement.

DESCRIPTION OF THE PREFERRED EMBODIMENT

Figure 1:
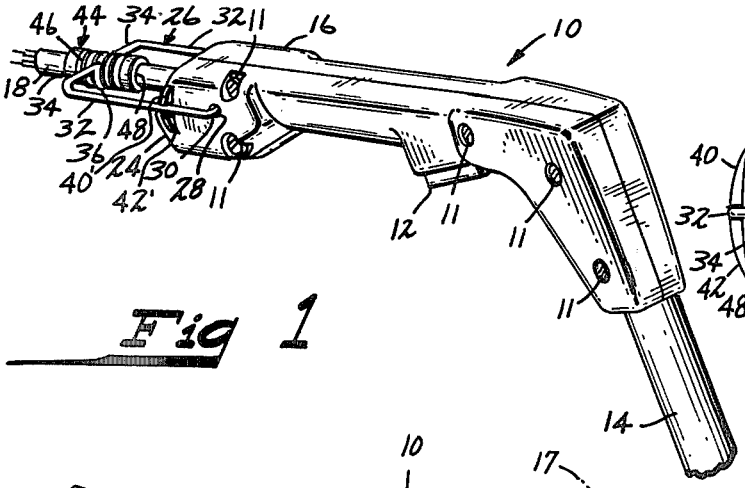
FIG. 1 is a fragmentary perspective view of the invention as embodied in the handle of a monofilament line trimmer or similar electrical power implement.
Figure 4:
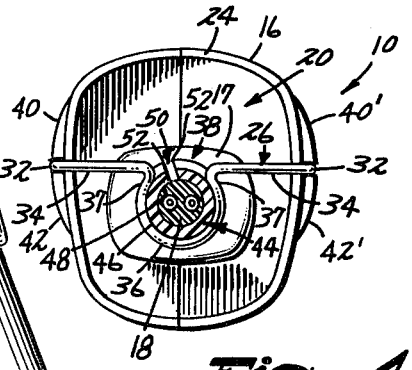
FIG. 4 is a sectional view as seen from the line 4—4 of FIG. 3.
Figure 2:
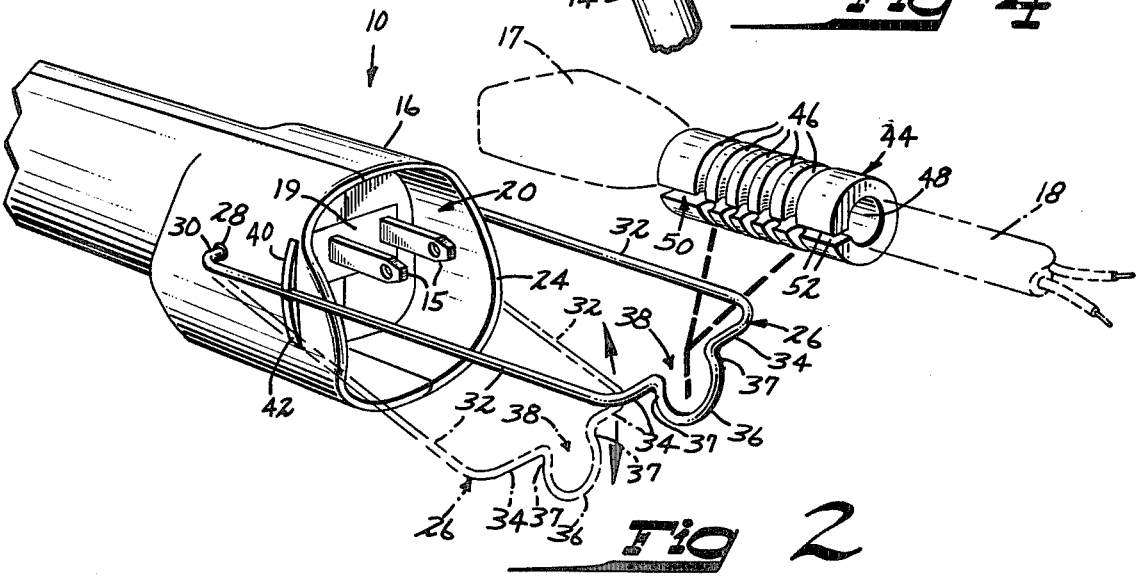
FIG. 2 is a fragmentary exploded perspective view of the butt end of the handle thereof.
Figure 3:
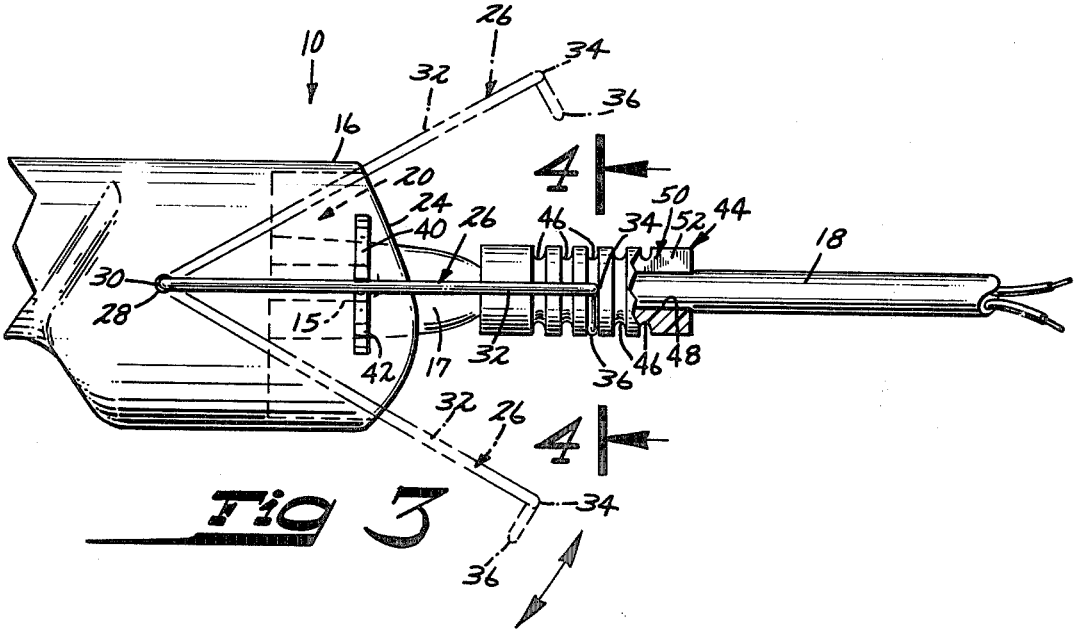
FIG. 3 shows a side view of the butt end of the handle thereof.

Referring to the figures, wherein like reference numerals denote like elements, a handle 10 of a monofilament line trimmer or similar electrically powered implement is shown. In the preferred embodiment the handle is constructed by mating together two, virtually symmetrical, molded plastic halves. Secure mating can be accomplished by means of machine screws 11. This construction facilitates manufacture of the implement by permitting easy insertion of the various internal components. Illustrative of components which may be incorporated are a power trigger 12, a handle extension 14, and electrical prongs 15, as shown best in FIG. 2. The butt end 16 of the handle 10 is flared, and an electrical connector 19 is contained herein. Access to the connector is afforded through a butt cavity 20. FIG. 2 shows a male configured electrical connector with two parallel extending electrical prongs 15, but the invention will function equally as well with any conventional type electrical connector. When the male configuration is used, however, the prongs are recessed within the cavity so that the cavity lip 24 extends beyond their ends, thus affording protection against damage to the prongs.

A retention member, which in the embodiment shown is a generally U-shaped bail 26, is shown pivotally mounted at 28, proximate the electrical connector, by inwardly turned extensions 30 of the bail which function as shafts allowing for the pivotal mounting. Any number of methods may, however, be employed to accomplish the pivotal mounting. The bail further comprises two elongated, generally parallel, and dimensionally similar extension arm rods 32, an interconnecting clip rod 34, and a clasping means shown as a formed wire clip 36 mounted on the clip rod generally midway between the ends thereof. The clip is tapered near its base, as shown at 37, so as to allow retention of a mating means within aperture 38. The clip defines a plane which is oriented generally orthogonal to a plane defined by the extension arm rods and the clip rod. In the preferred embodiment, the bail is integrally formed from a single piece of wire stock.

It will be apparent to one of skill in the art that forms of structure other an a multi-armed bail can serve to retain a second connector. One alternative retention member is a single arm, pivotally mounted on the under side of the flared butt end, to which is mounted a clasping means similar to that detailed above.

The preferred embodiment incorporates as a mating means a generally cylindrical elastomeric sleeve 44. Cannelures 46 formed in the outer surface of the sleeve 44 define discrete connection points for accepting the wire clip clasping means 36 of the bail 26. The sleeve 44 has a central bore 48 having a longitudinal axis coinciding with that of the sleeve 44. A slit 50 at a point on the circumference of the sleeve and running its length allows free external communication with the central bore. Employment of such a slit permits the sleeve to be freely attached to and detached from an electrical power extension cord 18. Insertion and withdrawal of the cord 18 is accomplished by prying apart the slit edges 52 to permit free passage of the cord 18. After insertion of the cord 18 is completed, the elastomeric nature of sleeve 44 precludes inadvertent disengagement of the cord 18 from the sleeve 44. Similarly, the elastomeric property of the sleeve 44 enables is to be slid freely along the length of the extension cord 18. In other embodiments, the sleeve 44 may be permanently attached to a power extension cord 18 without use of the slit 50.

When the preferred embodiment is to be used, operation of the present invention is performed as follows: The electrical connector 17 of the power extension cord 18 is mated to the electrical connector 19 of the implement. This mating is accomplished without obstacle since the free-swinging nature of the bail 26 permits it to be pivoted clear of the butt cavity 20. After mating is completed, the elastomeric sleeve 44 is positioned abutting the electrical connector 17 of the extension cord 18. With the sleeve 44 in this position, the bail 26 is pivoted until the clip portion 36 securely clasps the sleeve 44 at the most accessible connection point 46. The plurality of connection points 46 ensures that this clasping will occur without requiring withdrawal of either the sleeve 44 from its position abutting the extension cord's electrical connector 17 or the extension cord's electrical connector 17 from its completely mated position with the electrical connector 19 of the implement.

Mounted to the sides of the butt end 16 of the handle 10 are upper (40 and 40') and lower (42 and 42') ramp locking tabs. These tabs function to fixedly position the bail 26 along an axis defined by the connecting of the electrical connector 19 of the implement and that of the extension cord 17. By rigidly maintaining this orientation of the bail 26 while it is clasping the elastomeric sleeve 44, shearing stress on the male electrical prongs 15 is reduced. When connecting or disconnecting the electrical connectors 17, 19 or during storage of the implement, the bail 26 can be popped free of its retention position between the locking tabs 40, 40', 42, 42', and swung clear of the butt cavity 20, thus affording unimpeded access thereto.

In other embodiments, the central bore 48, through the elastomeric sleeve 44 can be of a diameter smaller than that of the extension cord 18 with which it is to be used. When the clip of the bail 26 is mated with the sleeve 44, the sleeve 44 is thereby made to securely grasp the cord 18. In this embodiment, the connection can be made so that a slack portion of the extension cord 18 is permitted between the sleeve and the mated connectors. By so doing, the shearing stress on the male electrical prongs 15 can be virtually eliminated.

Although the electrical connector retaining device has been described above in terms of specific embodiments and preferred constructions, it will be of course understood that the invention is defined in the appended claims, and many alternatives and modifications within the spirit and scope of the invention as defined by these claims will occur to those of skill in the art.

What is claimed is:

1. A device for securely retaining electrical connectors in a mated configuration, comprising:

a generally U-shaped bail comprising two generally parallel and dimensionally similar retention arm rods, each having a first end for pivotal mounting to a first electrical connector, and an interconnecting clip rod, having two ends each intersecting a second end of a retention arm rod;

mounting means for pivotally mounting said generally U-shaped bail by said first ends of the retention arm rods to the first connector; and mating means carried by a second connector, comprising a plurality of connection points spaced axially with respect to an axis defined by the connection of the first and second connectors, each of said connection points functioning as a receptacle for accepting said clip rod.

2. The device of claim 1 wherein the connection points of the mating means comprise discrete annular grooves associated with said second connector.

3. A device for securely retaining electrical connectors in a mated configuration comprising:

a generally U-shaped bail comprising two generally parallel and dimensionally similar retention arm rods, each having a first end for pivotal mounting to a first electrical connector, and an interconnecting clip rod, having two ends each intersecting a second end of a retention arm rod;

mounting means for pivotally mounting said generally U-shaped bail by said first ends of the retention arm rods to the first connector;

mating means carried by a second connector comprising a plurality of spaced connection points each of said spaced connection points functioning as a receptacle for accepting said clip rod; and means for fixedly positioning the bail with the retention arm rods parallel to an axis defined by connection of the first and second connectors.

4. The device of claim 3 wherein the positioning means comprises pairs of upper and lower ramp locking tabs, one of each pair mounted proximate each other on a first side of said first electrical connector, and one of each pair mounted proximate each other on a second side of said first electrical connector, said tabs positioned so as to form therebetween a bail locking detent.

5. A device for securely retaining electrical connectors in a mated configuration, comprising:

an elongated retention member having a first end for pivotal mounting to a first electrical connector;

means for pivotally mounting the retention member by said first end to the first connector;

clasping means mounted proximate a second end of the elongated retention member; and mating means, carried by a second electrical connector, comprising a plurality of discrete cannelures defining connection points associated with said second connector, said cannelures spaced axially with respect to an axis defined by the connection of the first and second connectors, said mating means comprising an element having a bore formed therethrough sized to accommodate an electrical cable extending from said second electrical connector, and a slit, extending the length of said bore, splitting said element on one side of said bore, whereby said element can be removed from the electrical cable;

whereby the device may accomplish secure retention as a result of the clasping means securely clutching the mating means at one of the connection points.

6. The device of claim 5 wherein the clasping means comprises a formed wire clip.

7. The device of claim 5 further comprising means for fixedly positioning the retention member with its elongation parallel to an axis defined by connection of the first and second connectors.

* * * * *